United States Patent [19]

Nishiyama

[11] 4,285,371

[45] Aug. 25, 1981

[54] METHOD FOR GUIDING WARP THREADS WITH A BACK REED

[75] Inventor: Hissai Nishiyama, Hayahoshi, Japan

[73] Assignee: Yoshida Kogyo K. K., Tokyo, Japan

[21] Appl. No.: 50,341

[22] Filed: Jun. 20, 1979

[30] Foreign Application Priority Data

Jun. 22, 1978 [JP] Japan ..... 53-76017

[51] Int. Cl.[3] ..... D03D 49/00; D03D 49/04

[52] U.S. Cl. ..... 139/97

[58] Field of Search ..... 139/97, 48, 101, 103, 139/1 C

[56] References Cited

U.S. PATENT DOCUMENTS

| | | | |
|---|---|---|---|
| Re. 17,934 | 1/1931 | Moore | 139/101 |
| 679,863 | 8/1901 | Ryon | 139/48 |
| 712,358 | 10/1902 | Caldwell | 139/101 X |
| 1,439,331 | 12/1922 | Schofield | 139/1 C |
| 2,383,767 | 8/1945 | Brownlow et al. | 139/48 X |
| 3,143,149 | 8/1964 | Stoudenmire | 139/48 |
| 3,166,884 | 1/1965 | Steiner et al. | 139/97 X |
| 3,451,435 | 6/1969 | Riha et al. | 139/1 C |

FOREIGN PATENT DOCUMENTS

| | | | |
|---|---|---|---|
| 56120 | 6/1911 | Switzerland | 139/192 |

*Primary Examiner*—James Kee Chi

*Attorney, Agent, or Firm*—Hill, Van Santen, Steadman, Chiara & Simpson

[57] ABSTRACT

A method for guiding warp threads with a back reed in a loom is provided, according to which the back reed is driven in reciprocative motion in a direction parallel to the dents thereof so that the points at which the running warp threads are contacted with each dent are distributed over the substantially whole length of the dents and, as a result, the accumulation of fluffy flue in the form of pills on as well as the local wear of the individual dents can be prevented, while productivity in weaving is improved and the serviceable life of the back reed may be extended. Pill-like fluffy flue eventually formed on the dents can be effectively removed by means of rollers which are provided on the back reed.

5 Claims, 4 Drawing Figures

METHOD FOR GUIDING WARP THREADS WITH A BACK REED

BACKGROUND OF THE INVENTION

The present invention relates to a method for guiding warp threads by means of a back reed in a loom for weaving tapes suitable for use as carrier tapes of slide fastener stringers and the like and also relates to a loom provided with a back reed movable reciprocatively in a direction parallel to the parallel pieces of slips, called dents, which are provided on the back reed and through between which the warp threads are passed.

In certain types of looms or weaving machines, as is well known, a plurality of warp threads wound around beams as cheeses are pulled out; they are run linearly as for example being guided by a guide roller, passed through a back reed whereby they are each warped to have regular intervals from the neighboring warp threads, fed to a tension roller where they have imparted to them a suitable tension, separated into an upper group and a lower group by means of a heddle so that the weft or filling is thrust therebetween with a filling carrier and beaten up to the web by means of a front reed to construct a woven cloth or tape.

Among the above-described steps, the step of warping the warp threads is performed conventionally with a back reed securely fixed and each of the warp threads is passed between two adjacent dents. One of the unavoidable problems in the above method of weaving is that, due to the stationary setting of the back reed, the warp threads run through the back reed in continuous contact with one and the same portion of each of the dents, so that the contacting points of the dents are often covered with pills of fluffy flue along with the local wearing of the dents to eventual forming of concaved recesses at the contacting points which in turn increase the nappiness of the warp threads coming out of the back reed.

SUMMARY OF THE INVENTION

An object of the present invention is to provide a method for guiding warp threads in which little or no pills of fluffy flue are formed on the dents of the back reed and in which the nappiness of the warp threads coming out of the back reed is greatly reduced.

Another object of the invention is to present a novel loom provided with a back reed which is movable reciprocatively in a direction parallel to the dents thereof.

Thus, the method of the present invention for guiding warp threads with a back reed comprises, in warping the warp threads linearly running after being pulled out from rolls by means of the back reed to impart regular intervals, giving a reciprocative motion to the back reed in a direction parallel to the dents of the back reed at a speed not to form nappiness in the warp threads running between and in contact with the dents with such a stroke that the contacting points of the warp threads with the dents are distributed substantially over the whole length of each dent.

The method is so effective that no pills of fluffy flue adhere to the dents of the back reed and breakage of the warp threads can be minimized owing to the distribution of the contacting points between the dents and the running warp threads.

The loom of the present invention can be made by simply remodeling a conventional loom since the only requirement is to provide a simple mechanism for driving the back reed in a reciprocative motion at a relatively low speed.

BRIEF DESCRIPTION OF THE DRAWINGS

The present invention will be described by way of example with reference to the accompanying drawings, wherein.

DETAILED DESCRIPTION OF THE PREFERRED EMBODIMENTS

Figure 1:
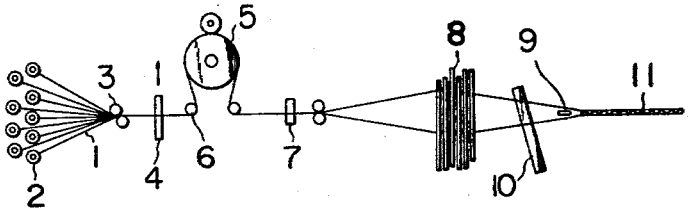
FIG. 1 is a schematic showing of the side view of a needle loom in accordance with the inventive method for guiding warp threads with a moving back reed.

FIG. 1 is a schematic showing of the weaving process in a needle loom, in which warp threads 1, unrolled and pulled out from a plurality of cheeses 2, are led and run linearly by means of guide rollers 3 and the running warp threads 1 are each warped by means of a back reed 4 to be imparted with regular intervals from the neighboring threads. Then, the warp threads 1 are led to a tension drum 5 by a guide roller 6 where each of the warp threads 1 has imparted to it a suitable tension and then passed through a breakage detector 7. Thus warped threads 1 are then separated into an upper group and a lower group alternately by means of a heddle 8 and the weft is thrust therebetween with a filling carrier 9 and beaten up to the web with a front reed 10 to continuously form a tape 11 of a continuous length.

In the method of the present invention, the back reed 4 is moved up and down in a direction parallel to dents 12 and crossing the running warp threads in linear reciprocative motion as the warp threads 1 pass between the dents 12 to be warped with regular intervals. The speed of the reciprocative motion of the back reed 4 is controlled not to be too fast in order to avoid excessive friction between the dents 12 and the running warp threads 1, which otherwise may produce nappiness in the running warp threads 1 coming out of the back reed 4. When the speed of the reciprocative motion of the back reed 4 is excessively high, the friction between the dents 12 and the warp threads 1 produces nappiness in the running warp threads 1, so that the fluffy flue will be increased. The stroke of the reciprocative motion of the back reed 4 is, preferably, such that the warp threads 1 are guided by the dents 12 over substantially the whole length thereof while the back reed 4 is moved up and down at a relatively low speed so as not to form nappiness in the warp threads 1.

Figure 2:
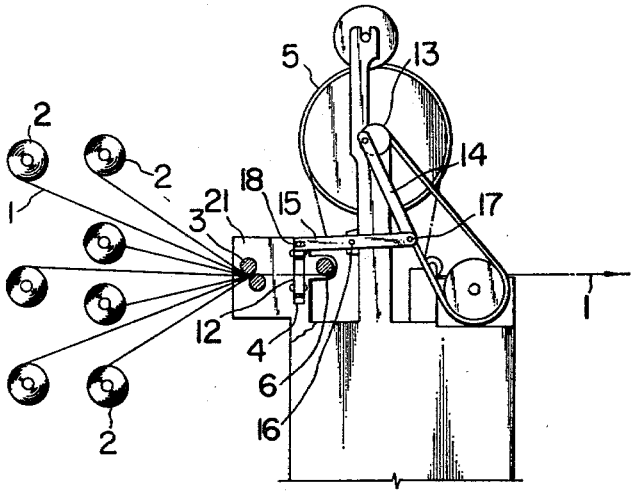
FIG. 2 is an elevational side view of the warping part of a loom in accordance with the inventive method partly as cut.
Figure 3:
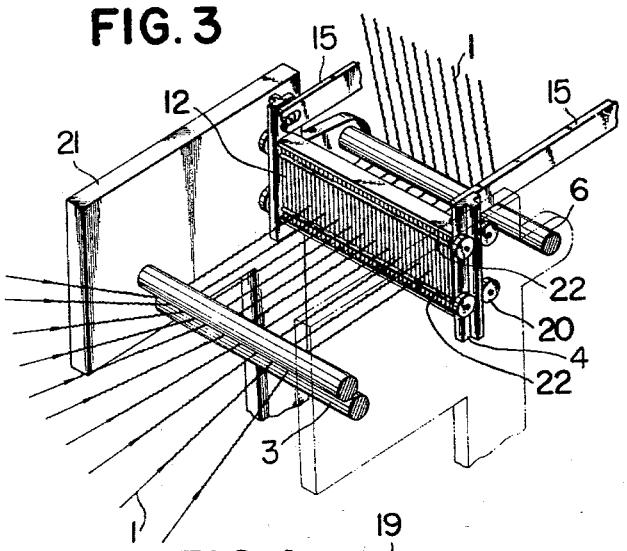
FIG. 3 is a perspective view of the same as in FIG. 2.
Figure 4:
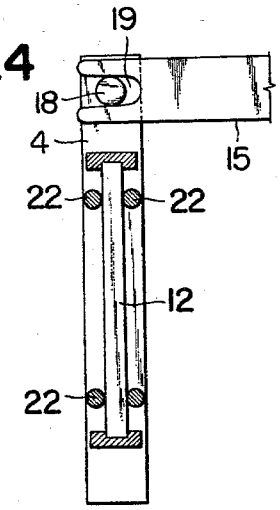
FIG. 4 is a cross sectional view of the back reed in accordance with the inventive method.

An example of a mechanism for driving the back reed 4 in reciprocative motion is illustrated in FIG. 2 and FIG. 3, according to which a pulley with a crank 13 is fixed coaxially to the tension drum 5 and a crank 14 is pivotally supported to a pulley 13 at an eccentric position. A lever 15 pivotally supported by a horizontal axle 16 at the center portion thereof is connected at one end to the lower end of the crank 14 with a pivot 17, the other end of the lever 15 being engaged with a pin 18 fixed to the frame of the back reed 4 as shown in FIG. 4, so that the back reed 4 is driven up and down by the swaying of the lever 15 around the horizontal axle 16 with the pin 18 sliding in an aperture 19 provided at the end of the lever 15. The movement of the back reed 4 is guided by guide rollers 20 pivotally supported by right and left brackets 21 so that the back reed 4 is driven within a plane defined by the guide rollers 20. The stroke of the reciprocative motion of the back reed 4 is determined by the eccentricity of the crank 14 at the pulley 13 and the lever ratio of the lever 15 around the horizontal axle 16 as the fulcrum. It is preferable that the running warp threads 1 do not come into contact with the upper and lower ends of the dents 12 even when the back reed 4 is in its uppermost or lowermost position. Furthermore, rollers 22 capable of free rotation are provided near the upper and lower ends of the dents 12 at such heights that the running warp threads 1 come into contact with the rollers 22 when the back reed 4 is in its lower or upper dead points, respectively, and rotate the rollers 22 whereby any fluffy flue accumulated at the lower and upper ends of the dents 12 is effectively discharged off the back reed 4. It is optional of course that air is blown at the flue-discharge rollers 22 to increase the efficiency of the removal of the fluffy flue, or the fluffy flue may be removed by a suitable suction means.

It should be understood that the mechanism for driving the back reed 4 in reciprocative motion is not limited to that described above. Any mechanism may be used for converting the rotational movement into reciprocative motion suitable for bringing the back reed 4 in linkage motion with the other rotating parts of the loom.

In the method of the present invention, the warp threads 1 are guided by the back reed 4 which is in continuous reciprocative motion within the plane formed by the dents 12 whereas the warp threads 1 run at a constant height so that the contacting points between the dents 12 and the running warp threads 1 are not fixed at a certain positions of the dents 12 but are distributed over the substantially whole length of the dents 12. Therefore, local wearing of the dents 12 can be avoided to increase the serviceable life of the back reed 4 along with the advantage that fluffy flue does not accumulate at the contacting points between the dents 12 and the warp threads 1, forming pills adhering to the dents 12, but the fluffy flue is pushed up and down by the running warp threads 1 in relative movement to the dents 12 remarkably decreasing the breakage of the warp threads 1 resulting in a great improvement of the efficiency of weaving.

An additional advantage of the inventive method is that simple remodeling of conventional looms is sufficient for the method since the back reed is moved in reciprocative motion without providing any device for moving the warp threads along the dents of the back reed, which device would necessitate complicated mechanisms for synchronizing the movement of the warp threads with other weaving mechanisms, such as the front reed and filling carrier.

What is claimed is:

1. A loom having a back reed, with dents for spacing warp threads running therethrough and which is movable in reciprocative motion in a direction parallel to the dents and vertically transverse to the running direction of the warp threads, and a rotating tension drum to impart tension to the running warp threads wherein the reciprocative motion of the back reed is effected by a linkage in connection with the tension drum.

2. A loom as claimed in claim 1 wherein the stroke of the reciprocative motion of the back reed is such that the warp threads running through between the dents come into contact with the surfaces of the dents at positions near the lower ends and the upper ends of the dents when the back reed is in its highest position and lowest position, respectively.

3. A loom having a back reed with dents for spacing at regular intervals warp threads running therethrough, said dents being parallel with one another and extending in a direction vertically transverse with the running direction of the warp threads, a rotating tension drum receiving the warp threads from said back reed for imparting tension to the running warp threads, and means for giving a reciprocative motion to said back reed in a direction parallel to said dents such that contact of warp threads with said dents is distributed substantially over the whole lengths of said dents.

4. A loom as claimed in claim 3, wherein said means for reciprocating said back reed comprises a linkage driven by said tension drum.

5. A loom as claimed in claim 3, wherein the warp threads running through between said dents come into contact with the surfaces of the dents at positions near the lower ends and upper ends of said dents when said back reed is in its highest position and lowest position, respectively.

* * * * *